United States Patent [19]

Harty

[11] 4,016,611

[45] Apr. 12, 1977

[54] SOFA BED AND MECHANISM THEREFOR

[75] Inventor: M. Fillmore Harty, Bloomfield Hills, Mich.

[73] Assignee: The Dow Chemical Company, Midland, Mich.

[22] Filed: Apr. 2, 1976

[21] Appl. No.: 673,338

[52] U.S. Cl. ..... 5/13; 5/29

[51] Int. Cl.[2] ..... A47C 17/10

[58] Field of Search ..... 5/13, 17, 18, 28, 29, 5/36

[56] References Cited

UNITED STATES PATENTS 3,296,632 12/1965 Hoffman ..... 5/13

3,877,087 4/1975 Harty ..... 5/13

3,908,210 9/1975 Alembik ..... 5/13

*Primary Examiner*—Casmir A. Nunberg

*Attorney, Agent, or Firm*—Robert B. Ingraham

[57] ABSTRACT

A sofa bed and sofa bed mechanism are disclosed wherein a three-piece support is employed for the sleeping cushioning element which retracts to a conventional sofa configuration and expands easily to provide a bed of conventional sleeping height. The mechanism is simple, rugged and tolerant of manufacturing variations.

5 Claims, 9 Drawing Figures

SOFA BED AND MECHANISM THEREFOR

In order to maximize living space, many people employ a unit of furniture sometimes referred to as a sofa bed or convertible couch. Such a sofa bed is convertible from a couch or sofa into a single or double bed by rearranging the cushioning and support means. Oftentimes such convertible couches do little more than spread the major cushioning over an adjacent floor portion and in effect provide a sleeping surface substantially lower in height than that of a conventional bed. Such an arrangement can be referred to as a low sleeping surface. Low sleeping surfaces are often considered by many people to be undesirable. This factor may be physical or psychlogical, but nevertheless usually many people prefer a bed having a normal sleeping height, such as from about 16 to 18 inches above floor level. Two such convertible sofa bed arrangements are shown in my earlier U.S. Pat. No. 3,877,087 and U.S. Pat. No. 3,916,460. The arrangement shown in U.S. Pat. No. 3,877,087 is popularly referred to as a "parallel sleeper" wherein the sofa bed in the sleeping configuration receives the body of the user oriented in such a manner that it is parallel to the back of the sofa. The mechanism disclosed in U.S. Pat. No. 3,877,087 is highly desirable for such configurations but requires relatively precise manufacturing tolerances to obtain a mechanism which reliably opens to the desired sleeping configuration when force is asymmetrically applied to open the couch.

It would be desirable if there were available a convertible couch and mechanism therefor which on closing reliably followed the desired closing sequence when the closing force is applied asymmetrically to the couch when in the sleeping configuration.

It would also be desirable if there were available an improved convertible couch or sofa bed and mechanism therefor which could be fabricated from readily available materials.

These features and further advantages in accordance with the present invention are achieved in a convertible couch mechanism, the convertible couch mechanism having a first or base member adapted to be disposed upon a floor or like support means, the first or base member having a back end and a front end, a first leg member having a first or pivot end and a second or support end, the first end of the first leg member being pivotaly affixed to the base member at a location adjacent the back end and remote from the front end, a second or sliding member, the second or sliding member having a back end and a front end, the back end of the sliding member being slidably supported by the first or base member, the second or front end of the sliding member being supported or supportable by a floor or like support means, a first sleeping surface support means having a back end and a front end, and back end of the first sleeping support surface being pivotally affixed to the second end of the first leg, a second sleeping support surface having a back end and a front end, the back end of the second sleeping support surface being pivotally affixed to the front end of the first sleeping support surface, a second leg means pivotally affixed to first and second sleeping support means at the front and back ends respectively, the second leg means permitting rotation of the first and second support means about their pivotal connection by a rotation of about 90° to permit the first and second sleeping support means to be disposed in a generally parallel face-to-face relationship or alternately in general coplanar relationship, a third sleeping support means having a back end and a front end, the front and back ends of the second and third sleeping support means being pivotally affixed to permit rotation of the second support means at least about 90° about the back end of the third support means to permit rotation of the second sleeping support from the plane of the third sleeping surface support to a plane 90° thereto, the axes of pivotal connection between the first and second sleeping support surfaces and second and third sleeping support surfaces being generally parallel, a third leg means having a first end and a second end, the second end being pivotally affixed to the back end of the third sleeping support means, the first end being pivotally affixed to the front end of the second or sliding member, a fourth leg means having a first end and a second end, the first end of the fourth leg means pivotally attached to the front end of the second or sliding member and the second end of the fourth leg means being pivotally affixed to the third sleeping surface support means at a location generally between the front end and the back end of the third sleeping support means; the second or sliding member, the third sleeping surface support means, third and fourth legs forming generally a parallelogram thereby providing a mechanism which, in a folded or closed position, discloses the first and second sleeping supports in a generally vertical face-to-face relationship adjacent the first end of the base member and in the open position discloses the first, second and third sleeping supports in a generally planar configuration spaced from the base member and the sliding member.

Also contemplated within the scope of the present invention is a pair of mechanisms, as hereinbefore described, having like legs interconnected and upholstered with a synthetic resinous foamable material to form a convertible couch.

Further features and advantages of the present invention will become more apparent from the following specification taken in connection with the Drawing wherein.

Figure 1:
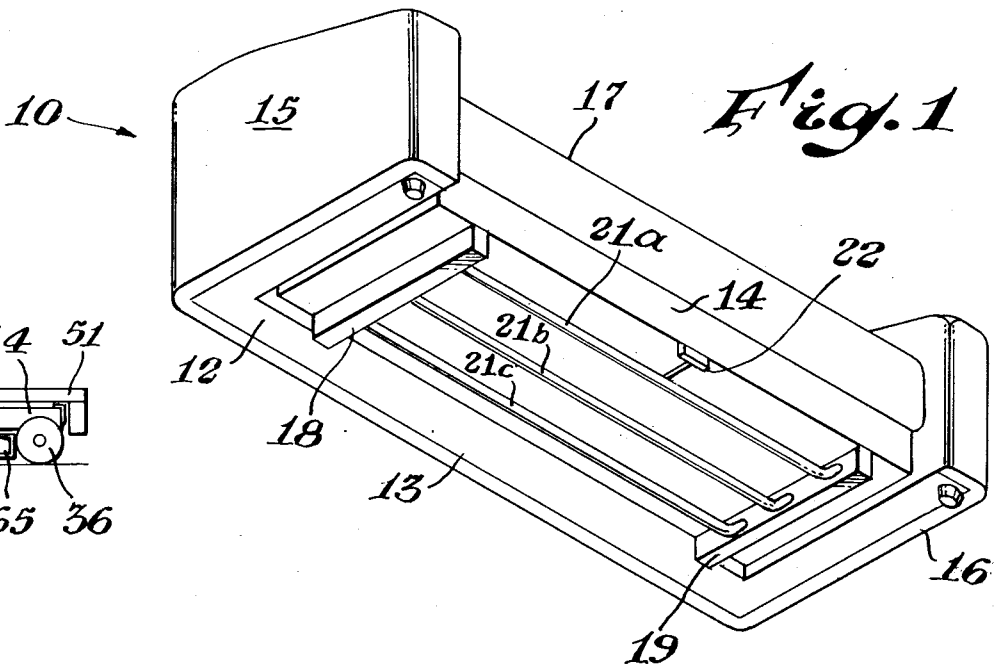
FIG. 1 is a schematic representation of a convertible couch of the present invention.

In FIG. 1 there is schematically depicted a sofa bed in accordance with the present invention generally designated by the reference numeral 10. The sofa bed 10 comprises in cooperative combination a frame 12 having a back 13 and a front 14, a first end 15 and a second end 16, a sleeping or seating portion 17 upholstered generally in accordance with my hereinbefore referenced patents, a first mechanism 18 is disposed from the bottom-most portion of the sofa 10. The mechanism 18 generally extends from the rear to the front. The first mechanism 18 is disposed generally adjacent the end 15 and a second mechanism 19 adjacent the end 16. Three tubular leg connectors 21a, 21b and 21c extend from the first mechanism 18 to the second mechanism 19 and provide a generally rigid connection between the legs of the mechanisms 18 and 19. A latch mechanism 22 is disposed generally adjacent the front 14 of the convertible couch or sofa 10 and is in operable connection with the adjacent leg connector 21a by means not shown.

Figure 2:
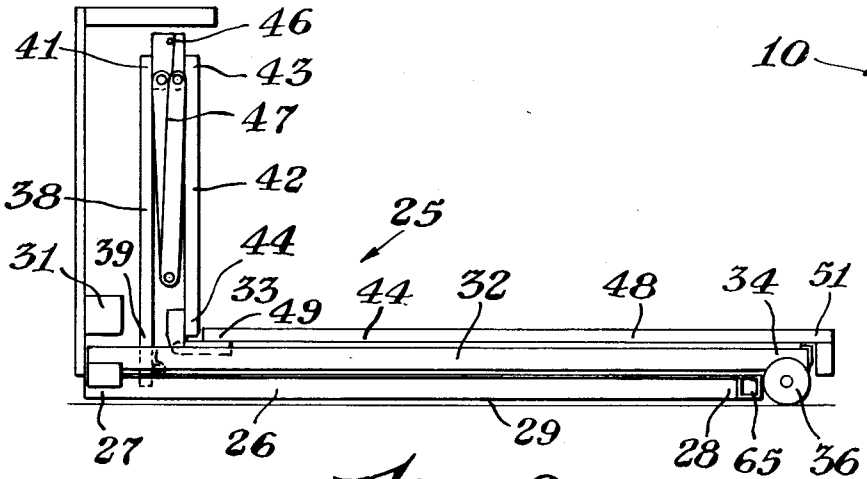
FIG. 2 is a simplified schematic representation of the mechanism of a convertible couch of the present invention in the closed or sitting configuration.

In FIG. 2 there is schematically represented a convertible sofa bed mechanism in accordance with the present invention generally designated by the reference numeral 25. The mechanism 25 is shown in the closed or sitting position. The mechanism 25 comprises a first or base member 26, the base member 26 has a first or back end 27 and a second or front end 28. The base member 26 is adapted to be supported on a floor such as the floor 29 and is affixed to a sofa bed frame 31 beneficially of a generally U shaped configuration. A second or sliding base member 32 has a first or rear end 33 and a second or front end 34, the base member 32 is disposed adjacnet the base member 26 and is generally parallel thereto, the first or rear end of the base member 32 is slidably supported by the base member 26 by means not shown. The second end of the sliding base member 32 is supported by the floor 29 by means of a roller 36. A first sleeping support means or surface 38 is disposed generally perpendicular to the base members 26 and 32. The first sleeping surface support 38 has a first or rear end 39 and a second or front end 41. A second sleeping support means or surface 42 is disposed generally parallel to the first sleeping support surface 38, the second sleeping support means 42 has a first or rear end 43 and a second or front end 44. The second end 41 of the first support 38 and the first end 43 of the second support 42 are pivotally affixed by means of a pivot 46. A second leg means 47 is also pivotally supported by the second end 41 of the first surface 38 and the first end 43 of the second support means or surface 42. A third sleeping surface support means or surface 48 is disposed generally parallel to the members 26 and 32 and perpendicular to the members 38 and 42. The sleeping surface support means 48 has a first or rear end 49 and a second or front end 51.

Figure 3:
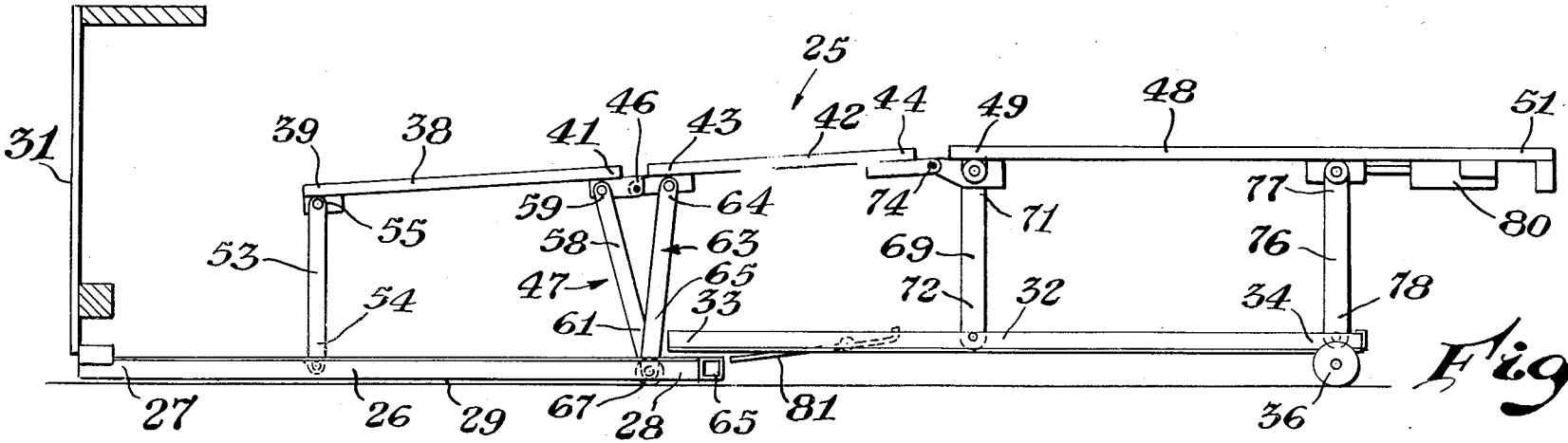
FIG. 3 is a schematic representation of the mechanism of FIG. 2 in the open or sleeping configuration.

In FIG. 3 there is a schematic representation of the mechanism of FIG. 2 in the open or sleeping position wherein the second or sliding member 32 has been moved until the first end 33 of the second member 32 is adjacent the second end 28 of the base member 26 and the second end 34 of the member 32 is remotely disposed from the second end 28 of the base or first member 26. The sleeping support means 38, 42 and 48 are disposed in a generally coplanar manner and spaced from the base members 26 and 32. A first leg 53 having a first end 54 and a second end 55 is pivotally affixed to the first or base member 26 at a location generally between the ends 27 and 28. The second end 55 is pivotally affixed to the first or rear end 39 of the first sleeping surface support member 38. Beneficially the leg 53 is affixed to a like leg on a similar mechanism in an arrangement such as depicted in FIG. 1 whereby both mechanisms are forced to move in unison. A second leg member 47 is disposed at a location lying generally between the pivot 46 and the floor 29. The leg 47 comprises a first elongate member 58 having a first or upper end 59 and a second or lower end 61. A second elongate member 63 having a first end 64 and a second end 65, the second ends 61 and 65 of the first and second members 58 and 63 beneficially are pivotally affixed and have a bearing pad or floor engaging means 67 such as a plastic roller. The first end 54 of the first leg 53 is pivotally affixed to the first sleeping surface support 38 at a location generally adjacent its front end 41. The first end 64 of the second elongate member 63 is pivotally affixed to the first or rear end 43 of the second sleeping surface support 42 thereby forming a four-bar linkage which provides an erect, more or less triangularly braced, second leg 47 in the open position and in the folded position such as depicted in FIG. 2. A mechanism connecting means or square tube 65 is rigidly affixed to the second end 28 of the first or base member 26 and extends across the front of a sofa bed such as the sofa 10 of FIG. 1 to provide rigid and reliable alignment of the base members of the two sofa bed mechanisms. A third leg 69 having a first end 71 and a second end 72 is pivotally affixed to the rear end 49 of the third sleeping surface support means 48, the leg 69 is also pivotally affixed at its second end 72 to the second or sliding support 32 at a location between the ends 33 and 34. A hinge or pivot 74 connects the second or front end 44 of the second sleeping support means 42 with the first end 49 of the third sleeping surface support means 48 at a location generally adjacent but rearwardly disposed of the pivotal connection between the first end 71 of the leg 69 and the rear end 49 of the sleeping surface support means 48. A fourth leg 76 is disposed generally adjacent the second end 34 of the sliding support 32. The leg 76 has a first end 77 and a second end 78. The first end 77 is pivotally affixed to the third sleeping surface support means 48 at a location generally adjacent the second end 51 of the support means 48 and remote from the first end 49 thereof. The second end 78 of the leg 76 is pivotally affixed to the second end 34 of the second or sliding support 32. Beneficially, the legs 69 and 76 are affixed to like legs of a similar mechanism by means of connecting rods or tubes such as those designated by the reference numerals 21a, 21b 21c of FIG. 1. A latching mechanism generally designated by the reference numeral 80 is shown generally between the second end 77 of the fourth leg 76 and the second end 51 of the third sleeping support surface 48. The latching means 80 is in operative combination with a bar or tube such as the tube 21a of FIG. 1 having its axis on the pivot axis of the second end 77 of the leg 76. A sequence lock 81 is disposed generally adjacent the first end 33 of the second support member 32.

Figure 4:
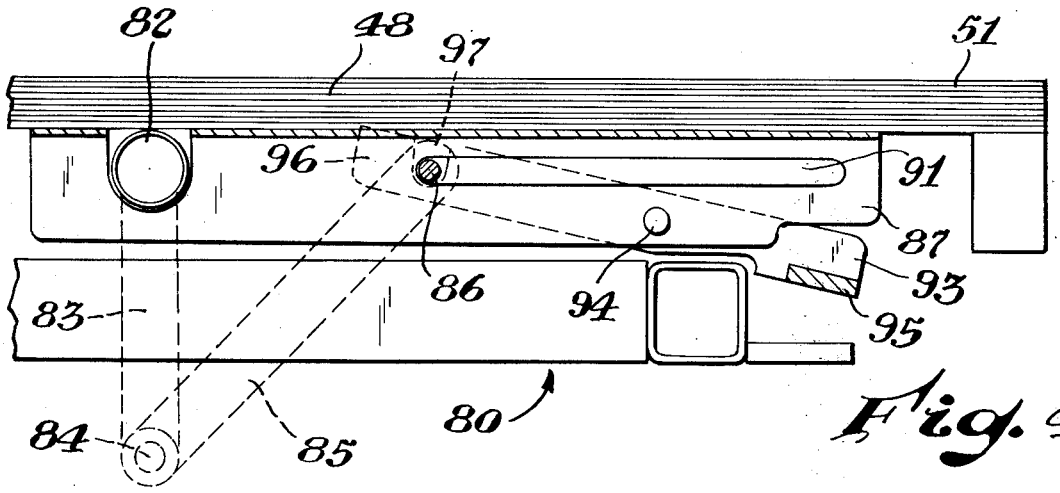
FIG. 4 is a schematic side representation of the locking mechanism employed with the mechanism of FIG. 3 in the open position.
Figure 5:
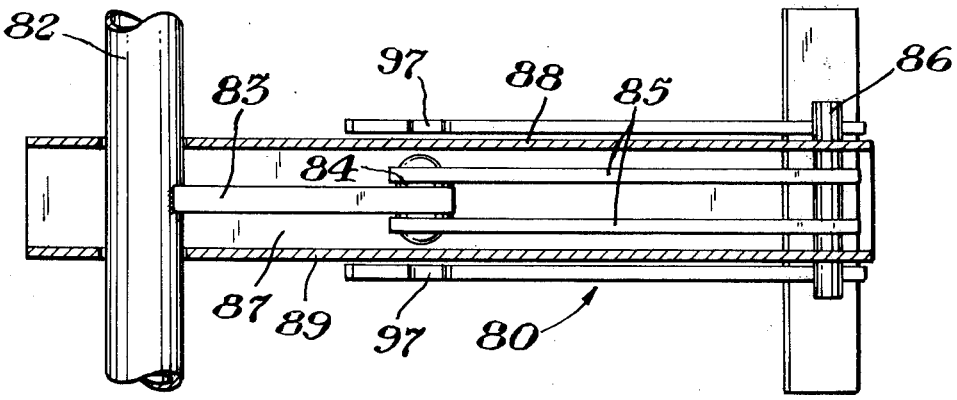
FIG. 5 is a bottom view of the mechanism of FIG. 4 in the closed position.

In FIGS. 4 and 5 there are depicted schematic representations of a latch mechanism in accordance with the present invention generally designated by the reference numeral 80. The latching means 80 in FIG. 4 is shown in the open or sleeping position corresponding to the positioning of the mechanism in FIG. 3 and the position in FIG. 5 shows the configuration that the latching mechanism 80 has in the closed position such as shown in FIG. 2. In FIGS. 4 and 5 there is pivotally mounted a connecting bar 82 (corresponding to bar 21a of FIG. 1) which extends between legs such as the legs 76. The bar 82 has an arm 83 rigidly affixed thereto. The bar 83 extends parallel to a leg such as the leg 76. The arm 83 terminates remote from the bar 82 in a pivot 84. A link arm 85 is pivotally affixed to the arm 83 at the pivot 84. Beneficially the link arm comprises a pair of parallel bars which in turn terminate remote from the pivot 84 in a transverse bar or locking pin 86. The end of the arm 85 terminates within a channel 87 having sides or flanges 88 and 89 which define a slot or way 91 which extends generally parallel to the major surface of the third sleeping support 48. Thus, as the rod 82 rotates in such a way as to bring the pivot 84 within the channel member 87, the link arm 85 is disposed parallel to the third sleeping support means 48. A latching member 93 is pivotally affixed to the channel 87 by means of the pivot 94. The latching means 93 has a first or operating end 95 and a second or latching end 96. The latching end 96 defines a pair of oppositely disposed parallel grooves or recesses 97 which optionally engage the pin 86 when the arm 83 extends generally normally to the third sleeping surface support means 48.

Figure 6:
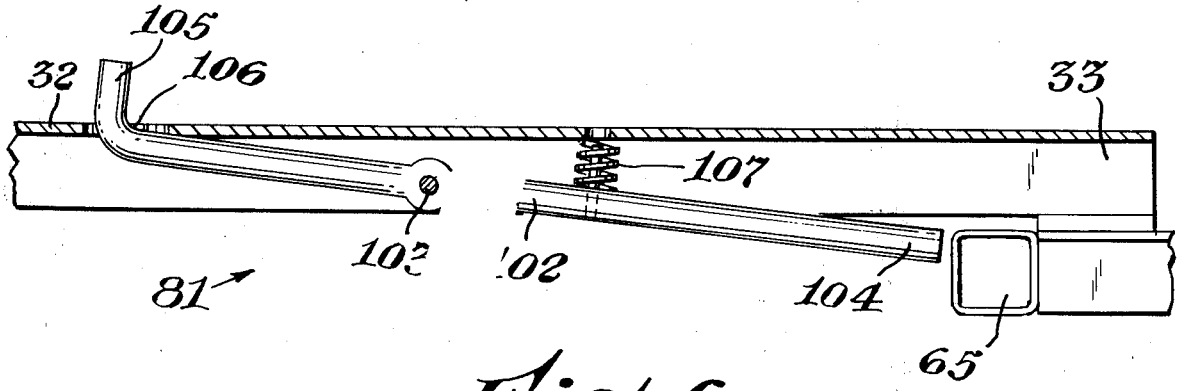
FIG. 6 is a schematic representation of a closing sequence lock employed with the mechanism of FIGS. 2 and 3.

In FIG. 6 there is schematically depicted a sequence of latching mechanisms generally designated by the reference numeral 81. The mechanism 81 comprises a generally L-shaped bar 102 pivotally supported within the second or sliding support member 32 at the first end 33. The bar 102 is pivotally supported within the member 32 by means of a pivot 103 generally disposed at the center of the bar. The bar 102 has a first or straight end 104 and a second or L-shaped end 105. The L-shaped end 105 projects through an opening 106 in the uppermost surface of the sliding member 32. A resilient tensioning means 107 resiliently tensions the bar 102 in such a manner that end 104 projects downwardly and outwardly from member 32. In the event that downward pressure is applied to end 105 of bar 102, end 104 is withdrawn inside member 32.

Figure 7:
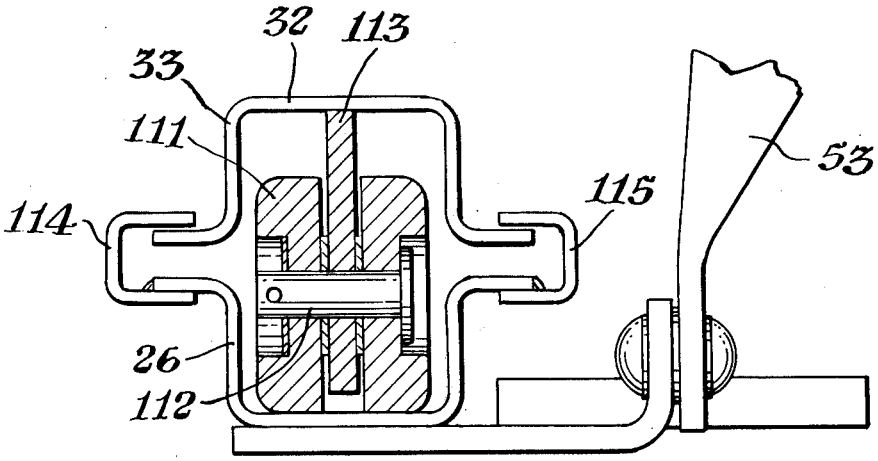
FIG. 7 is a fractional schematic view depicting the manner in which the second or sliding element is supported by the base element.

In FIG. 7 there is schematically depicted a sectional view through the base member 26 and sliding member 32 showing a split roll 111 pivotally supported on a shaft 112 which in turn is supported by a trunnion 113. A first guide channel 114 and a second guide channel 115 are rigidly affixed to the first support means 26. It should be noted that for convenience the base member 26 and the sliding member 32 have a generally channel-like configuration wherein the terminal portions of the channel flanges are outwardly flaring and are generally parallel to the web of the channels to provide a cross-section somewhat equivalent to the shape of a top hat. This configuration is particularly convenient for mechanisms in accordance with the present invention. Also depicted in FIG. 7 is the mode of attachment of the first leg 53 to the base 26.

Figure 8:
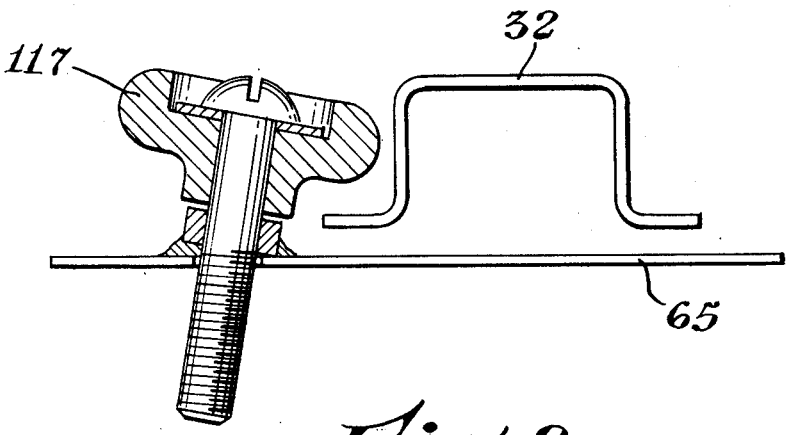
FIG. 8 is a representation of an anti-racking device.

In FIG. 8 there is depicted a guide roll 117 pivotally affixed to cross-member 65 and adapted to engage the sliding member 32. Advantageously, a guide roll 117 is disposed on each mechanism such as the mechanisms 18 and 19 of the sofa 10 of the FIG. 1 to prevent any significant misalignment of the members 32 relative to the members 26. Beneficially, the guide rolls such as 117 may be internal that is between the mechanisms or external on the outside of the mechanisms.

Figure 9:
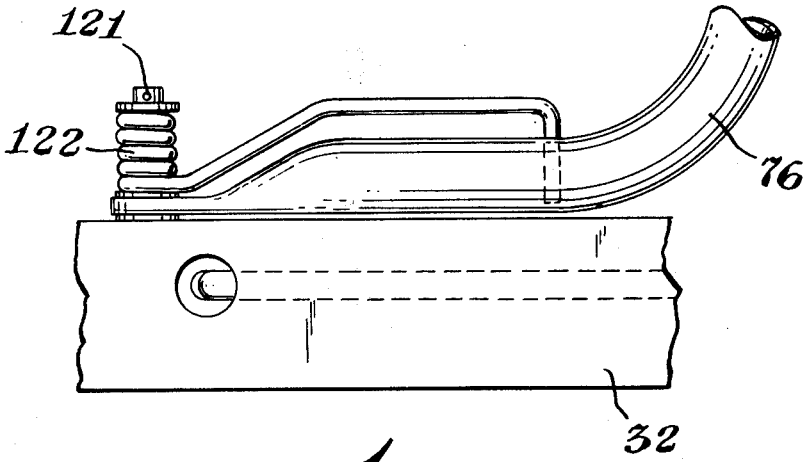
FIG. 9 depicts the manner in which the first, third and fourth legs are affixed to the base member.

In FIG. 9 there is depicted the mode of connecting a leg such as the leg 76 or 69 to the sliding member 32 by means of a pivot or stub shaft 121 and a tension spring 122 wound in such a manner that the legs are tensioned toward the upright position as depicted in FIG. 3.

In operation of the apparatus in accordance with the present invention as depicted in FIGS. 2 through 9, the sofa bed when in the configuration as depicted in FIG. 2 is drawn outwardly, that is, toward the right as depicted in FIG. 2. Roller 36 rolls over the floor as member 32 is drawn across the connector or cross member 65. The first and second sleeping support means 38 or 42 respectively are drawn apart or rotated about pivot 46 and depending upon the particular major components of force applied to the sofa bed the legs 69, 76 and 53 move into the erect position. The leg 47 is drawn downwardly until it encounters the floor. The opening sequence can vary, that is, the mechanism can be drawn well forward before the legs start to move to the erect position. As the third sleeping surface support 48 is moved upwardly away from the sliding member 32, end 105 of the rod 102 projects upwardly through member 32 and end 104 is forced downwardly. When extension is completed, end 104 butts against cross-member 65. In the upright position the arm 83 of FIGS. 4 and 5 extends generally normally to the third sleeping surface support 48 and pin 86 engages the groove 97. Advantageously, the latching arm 93 is weighted or resiliently tensioned to cause engagement with the pin 96 in the groove 97 and lock the mechanism in the extended or sleeping position. The upholstery and cushioning elements employed with the mechanism of the present invention are generally those as depicted in my U.S. Pat. No. 3,877,087, the teaching of which is herewith incorporated by reference hereto. When it is desired to return a couch with the mechanism of the present invention to the seating position, the first end 95 of the latching arm 93 is raised to disengage the pin 86 from the grooves 97 of the second end 96 of the latching arm 93. Gently pushing the second end 51 of the third sleeping surface support 48 or the front edge of the upholstered assembly, the legs 69 and 76 are caused to fold into a horizontal position. The first and second sleeping surface support members 38 and 42 move upwardly at a location corresponding to pivot 46. When the legs 69 and 76 are generally parallel to the member 32, end 105 of the rod 102 is depressed roughly parallel to the member 32 disengaging end 104 from the cross-member 65. The mechanism may then be slid toward the back of the couch and assumes the configuration depicted in FIG. 2.

As depicted in the drawing, the sleeping support surfaces are planar sheet-like elements such as plywood, particle board, or the like wherein the various pivots have been affixed directly to the sleeping support surfaces. In the event that it is desirable to minimize the weight of the structure, sleeping support surfaces may comprise bars extending between the pivots, essentially replacing the elements 38, 42 and 48. Such bars, channels, tubes or like elongate elements may then be connected to planar elements such as the thinner plywood, hardboard, particle board, or the like.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A convertible couch mechanism, the convertible couch mechanism having a first or base member adapted to be disposed upon a floor or like support means, the first or base member having a back end and a front end, a first leg member having a first or pivot end and a second or support end, the first end of the first leg member being pivotly affixed to the base member at a location adjacent the back end and remote from the front end, a second or sliding member, the second or sliding member having a back end and a front end, the back end of the sliding member being slidably supported by the first or base member, the second or front end of the sliding member being supported or supportable by a floor or like support means, a first sleeping surface support means having a back end and a front end, the back end of the first sleeping support surface being pivotally affixed to the second end of the first leg, a second sleeping support surface having a back end and a front end, the back end of the second sleeping support surface being pivotally affixed to the front end of the first sleeping support surface, a second leg means pivotally affixed to first and second sleeping support means at the front and back ends respectively, the second leg means permitting rotation of the first and second support means about their pivotal connection by a rotation of about 90° to permit the first and second sleeping support means to be disposed in a generally parallel face-to-face relationship or alternately in general coplanar relationship, a third sleeping support means having a back end and a front end, the front and back ends of the second and third sleeping support means being pivotally affixed to permit rotation of the second support means at least about 90° about the back end of the third support means to permit rotation of the second sleeping support from the plane of the third sleeping surface support to a plane 90° thereto, the axes of pivotal connection between the first and second sleeping support surfaces and second and third sleeping support surfaces being generally parallel, a third leg means having a first end and a second end, the second end being pivotally affixed to the back end of the third sleeping support means, the first end being pivotally affixed to the front end of the second or sliding member, a fourth leg means having a first end and a second end, the first end of the fourth leg means being pivotally attached to the front end of the second or sliding member and the second end of the fourth leg means being pivotally affixed to the third sleeping surface support means at a location generally between the front end and the back end of the third sleeping surface support means, the second or sliding member, the third sleeping surface support means, third and fourth legs forming generally a parallelogram, thereby providing a mechanism which, in a folded or closed position, discloses the first and second sleeping supports in a generally vertical face-to-face relationship adjacent the first end of the base member and in the open position discloses the first, second and third sleeping supports in a generally planar configuration spaced from the base member and the sliding member.

2. The mechanism of claim 1 in cooperative combination with a like mechanism, the mechanisms being connected by torque transmitting means extending between the fourth legs of each mechanism.

3. The mechanism of claim 2 including a latch means to lock the fourth legs in a generally vertical position when the mechanism is extended.

4. The mechanism of claim 3 wherein the locking mechanism is in cooperative combination with the torque transmitting means.

5. The mechanism of claim 4 including a synthetic resinous cushioning disposed over the first, second and third sleeping surface support means.

* * * * *